US005868283A

United States Patent [19]

Wilson et al.

[11] Patent Number: 5,868,283

[45] Date of Patent: Feb. 9, 1999

[54] RECLOSABLE CLOSURE AND BOTTLE

[75] Inventors: Tracie Wilson, Westminster; Gregory Alan Lathrop, Manchester, both of Md.

[73] Assignee: Lever Brothers Company, Division of Conopco, Inc., New York, N.Y.

[21] Appl. No.: 673,875

[22] Filed: Jul. 2, 1996

[51] Int. Cl.[6] ..... B67D 1/16

[52] U.S. Cl. ..... 222/111; 222/109; 222/525; 222/536; 222/556; 141/381

[58] Field of Search ..... 222/109, 111, 222/522–525, 556, 546, 534, 536, 562; 141/381

[56] References Cited

U.S. PATENT DOCUMENTS

| | | | |
|---|---|---|---|
| D. 160,487 | 10/1950 | Finch . | |
| D. 194,069 | 11/1962 | Houghton . | |
| D. 220,609 | 5/1971 | Dickins . | |
| D. 222,607 | 11/1971 | Weckman . | |
| D. 227,654 | 7/1973 | Byrne . | |
| D. 247,347 | 2/1978 | Klingaman . | |
| D. 250,806 | 1/1979 | Gutkowski . | |
| D. 251,358 | 3/1979 | Gutkowski . | |
| D. 275,734 | 10/1984 | Voice . | |
| D. 276,890 | 12/1984 | Hancher . | |
| D. 284,353 | 6/1986 | Prahs . | |
| D. 286,266 | 10/1986 | Vesborg et al. . | |
| D. 289,611 | 5/1987 | Seelig . | |
| D. 291,537 | 8/1987 | Crawford et al. . | |
| D. 304,301 | 10/1989 | Moss et al. . | |
| D. 305,407 | 1/1990 | Gonda . | |
| D. 334,538 | 4/1993 | Bolen, Jr. et al. . | |
| D. 338,407 | 8/1993 | Lynd . | |
| D. 346,963 | 5/1994 | Crawford . | |
| D. 358,334 | 5/1995 | Manderfield, Jr. . | |
| 2,901,153 | 8/1959 | Collins . | |
| 3,069,039 | 12/1962 | Stickney . | |
| 3,198,393 | 8/1965 | Kitterman | 222/109 |
| 3,511,420 | 5/1970 | Kessler . | |
| 3,881,643 | 5/1975 | La Vange . | |
| 4,047,643 | 9/1977 | Hazard . | |
| 4,282,991 | 8/1981 | Hazard . | |
| 4,441,637 | 4/1984 | Libit . | |
| 4,503,992 | 3/1985 | Joyce . | |
| 4,616,759 | 10/1986 | Mahler . | |
| 4,706,829 | 11/1987 | Li | 222/109 X |
| 4,772,560 | 9/1988 | Kittscher | 222/109 |
| 4,776,501 | 10/1988 | Ostrowsky . | |
| 4,903,870 | 2/1990 | La Vange . | |
| 4,917,268 | 4/1990 | Campbell et al. | 222/109 |
| 4,917,270 | 4/1990 | Simon | 222/111 |
| 4,962,869 | 10/1990 | Gross et al. . | |
| 4,993,605 | 2/1991 | Del'Re | 222/109 X |
| 5,020,699 | 6/1991 | Sams | 222/109 X |
| 5,188,249 | 2/1993 | Cargile | 222/111 X |
| 5,190,176 | 3/1993 | Lavange . | |
| 5,236,107 | 8/1993 | Spaanstra, Sr. . | |
| 5,413,232 | 5/1995 | Bergner . | |
| 5,462,202 | 10/1995 | Haffner et al. | 222/109 |
| 5,509,579 | 4/1996 | Robbins, III | 222/109 |
| 5,566,862 | 10/1996 | Haffner et al. | 222/111 |
| 5,597,090 | 1/1997 | Leahy | 222/109 X |

OTHER PUBLICATIONS

Exhibit A—Photocopy of a prototype bottle having the Lysoform body, a pour spout and a measuring cap.

Polytop Corporation brochure.

*Primary Examiner*—Kevin P. Shaver
*Attorney, Agent, or Firm*—Gerard J. McGowan, Jr.

[57] ABSTRACT

An improved container and closure therefore. The improved container includes a finish, a body extending downwardly from the finish, a fitment fit within the finish, the fitment including a pour spout extending upwardly, and a closure. The closure includes an upper wall having a product exit, which permits egress of the product. The product exit is reclosable so that in the closed position no product can escape from the container, wherein as in the open position product can be selectively dispensed from the container without removing the entire closure from the bottle. If so desired, the consumer can leave the product exit in the closed position, unscrew the closure from the bottle and use the inverted closure as a measuring cup for the product.

14 Claims, 12 Drawing Sheets

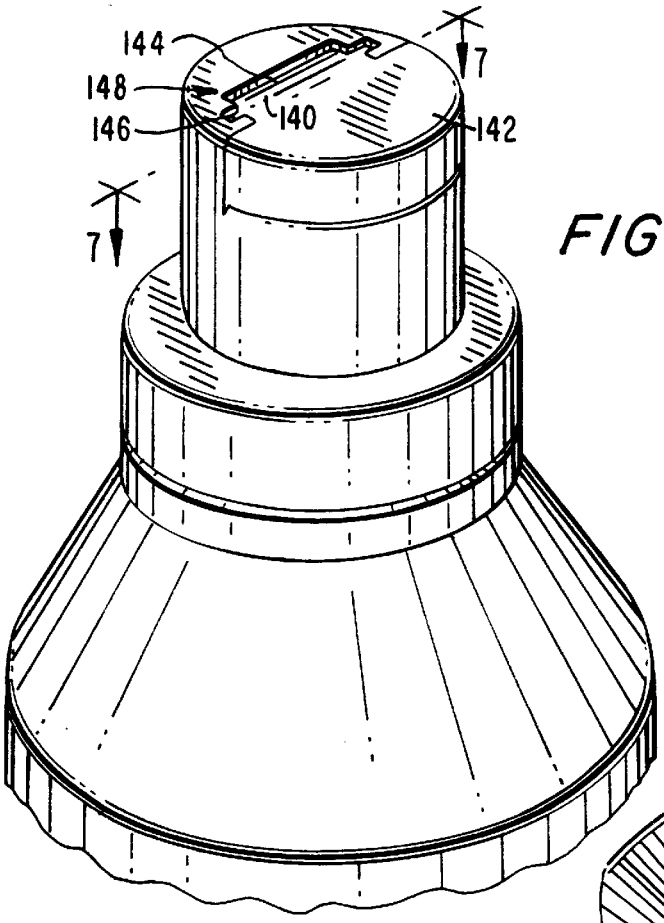
FIG. 6
FIG. 7
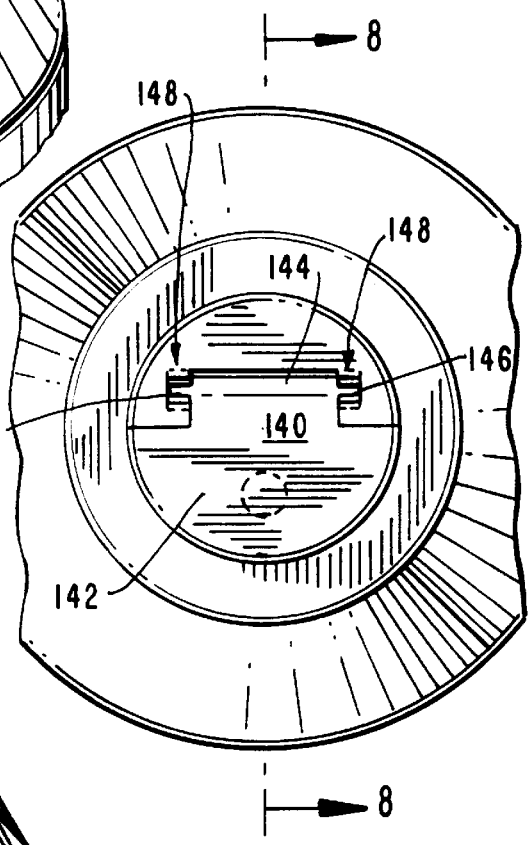
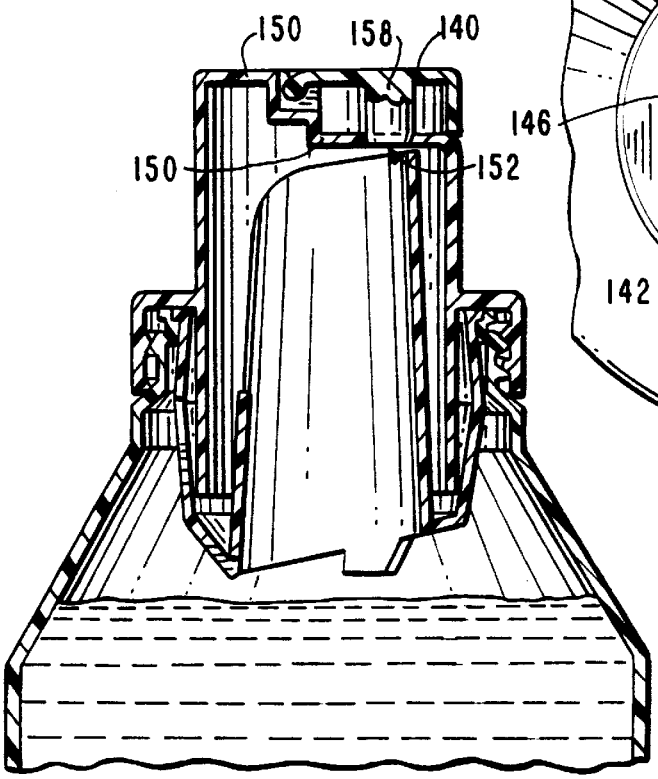
FIG. 8

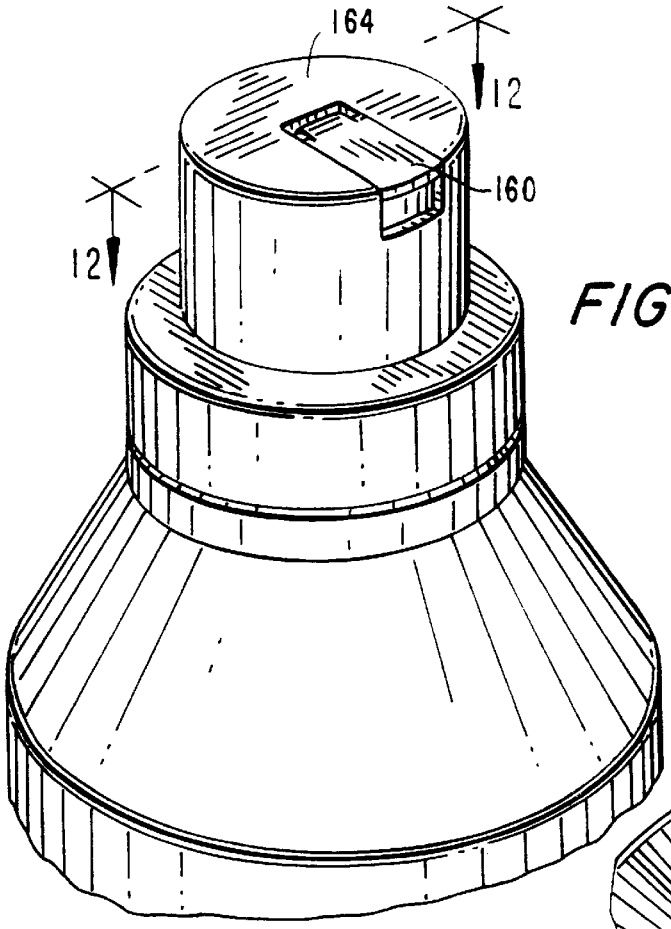
FIG. 11
FIG. 12
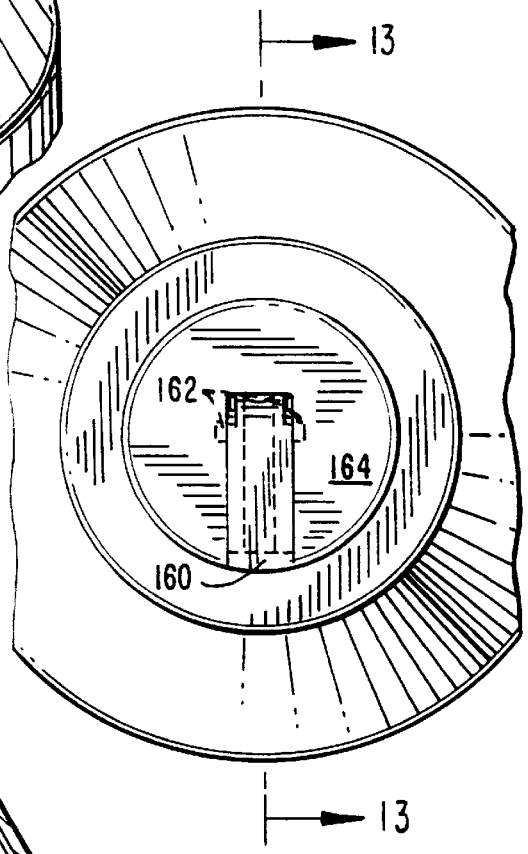
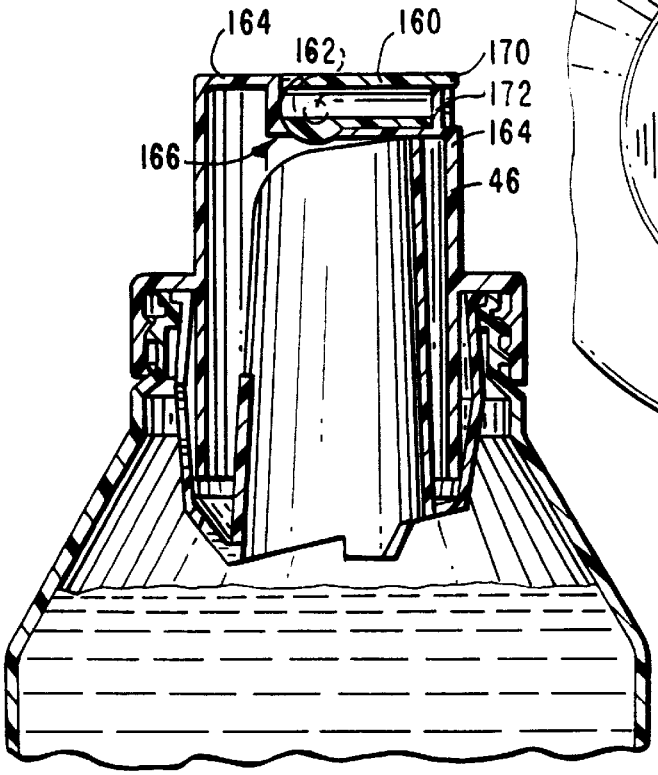
FIG. 13

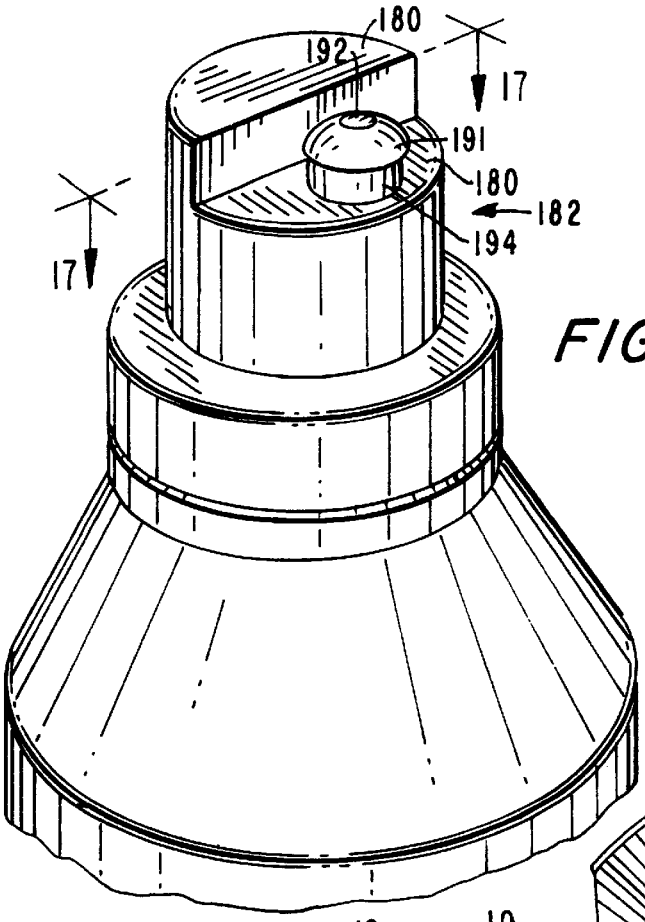
FIG. 16
FIG. 17
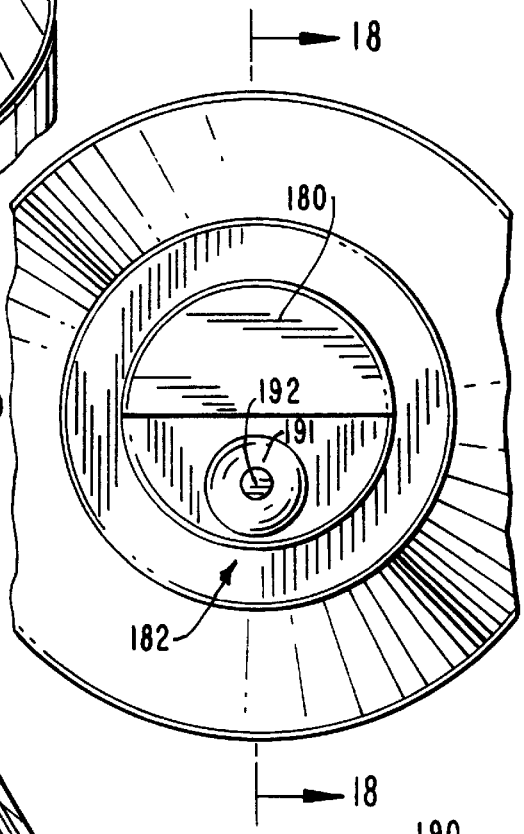
FIG. 18
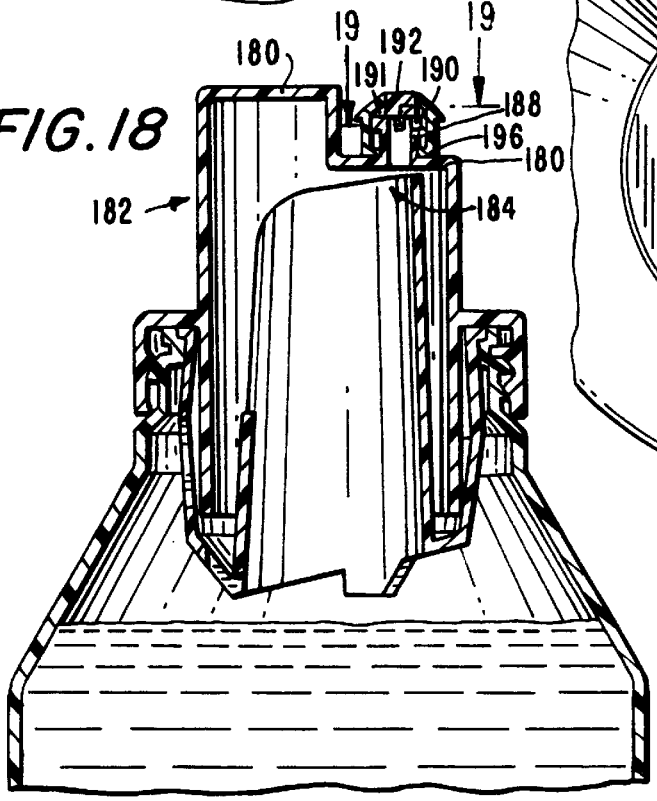
FIG. 19
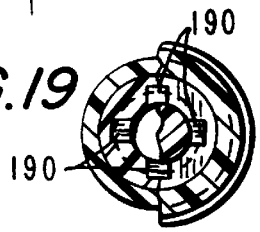

RECLOSABLE CLOSURE AND BOTTLE

BACKGROUND OF THE INVENTION

One popular form of laundry detergent is the laundry liquid. This is due in part to the convenience of that product form, in particular the ability to apply the detergent readily to soiled areas of the clothes. The popularity of laundry liquids has created a need for more convenient containers for dispensing these products. Thus, bottles having cups serving as measuring closures, and fitments incorporating drainage mechanisms and pouring spouts have appears on the market.

One type of container is exemplified by that of Barker, U.S. Pat. No. 4,550,862 wherein a bottle includes a fitment having a spout and a structure permitting the product to drain back into the container. The fitment has internal threads at its upper aspects which mate the external threads surrounding the mouth of a bottle cap.

Other containers have been developed using a different approach. The container disclosed in Davidson et al., U.S. Pat. No. 5,108,009 comprises a spout-and drainback-including fitment which snaps into the mouth of the bottle. The closure has internal threads situated within a flange which surrounds the measuring cup portion of the closure. The internal threads of the closure mate with external threads surrounding the neck opening.

Various other arrangements are disclosed in Hidding, U.S. Pat. No. 4,078,700, Livingstone, U.S. Pat. No. 2,763,402, Kitterman, U.S. Pat. No. 3,198,393, Baxter, U.S. Pat. No. 4,128,189, Livingstone, U.S. Pat. No. 2,743,844, Visser, U.S. Pat. No. 3,833,150, Lay, U.S. Pat. No. 4,844,302, and Bartimes et al., U.S. Pat. No. 5,330,083.

Since an important advantage of liquid laundry detergents is the ability to pretreat the clothes by pouring the detergent on the particular soiled areas, it is desirable that the pour spout permit fairly precise pouring onto specific areas. Many pour spouts on the market do not permit the consumer adequately to control the pouring so as to target successfully the area of the fabric onto which the liquid will be poured. There is a need, therefore, for a pour spout which improves the control of the user when pouring liquid products.

An additional desired feature of pouring spouts for laundry detergent and other products is the ability to dispense limited amounts of the product without going to the trouble of removing a closure. There is therefore a need for a container, particularly one suitable for liquid household products, which permits controlled dispensing to selected areas of the clothes without the need for screwing and unscrewing a closure.

Another desired feature of a successful liquid detergent container is good topload compression strength. Moreover, good topload compression strength may permit the elimination of dividers in shipping cases in certain instances and the attendant cost and waste to the environment. Improved handling on a filling line is another desired feature.

The present invention is directed to solving these and the problems associated with containers, particularly containers having pouring spouts suitable for dispensing liquid household products such as liquid detergents.

SUMMARY OF THE INVENTION

The present invention is directed to the discovery of an improved container and closure therefore. The improved container includes a finish, a body extending downwardly from the finish, a fitment fit within the finish, the fitment including a pour spout extending upwardly, and a closure.

The closure includes an upper wall having a product exit, which permits egress of the product. The product exit is reclosable so that in the closed position no product can escape from the container, whereas in the open position product can be selectively dispensed from the container without removing the entire closure from the bottle. If so desired, the consumer can leave the product exit in the closed position, unscrew the closure from the bottle and use the inverted closure as a measuring cup for the product.

The reclosable product exit arrangement can take many forms. In a preferred embodiment a cap is disposed above the upper wall and is pivotable between the open and the closed positions. In one embodiment the cap includes a circumferential depending wall which itself includes a product exit aperture. In this embodiment, the closure upper wall includes a further wall extending upwardly and perpendicularly to the upper wall and surrounding the product exit. The cap of this embodiment also includes a wall depending downwardly from the end wall of the cap which abuts the surrounding wall of the product exit when the cap is in the closed position.

In accordance with another preferred embodiment, the cap end wall includes a downwardly projecting plug which is accommodated within and closes the product exit when the cap is in the closed position.

In accordance with a still further embodiment, the cap comprises a narrow channel which constitutes only a small portion of the top of the closure. The channel includes an upper wall which extends beyond the product opening of the channel and the closure includes a side wall which abuts the extending upper wall when the channel is in the closed position thereby keeping the product within the closure.

In accordance with another embodiment, the cap is in the form of a bell having an aperture. In the closed position the aperture is closed by a plug whereas in the open position the aperture is open to permit product egress. The bell slides along walls forming the product exit.

The fitment of the container includes a spout and a drainback area. Preferably, the fitment snaps into the container finish so that a friction fit is obtained between the outer wall of the fitment and a locking ridge on the inside of the container finish. However, other arrangements are possible. The invention is also directed to a closure according to the embodiments of the invention.

The container may be of the types illustrated in Davidson et al., U.S. Pat. No. 5,108,009, especially the embodiment of FIG. 9, which patent is hereby incorporated by reference. Also possible is incorporation of the present design into a container of the type illustrated in Barker et al., U.S. Pat. No. 4,550,862, which is likewise incorporated by reference herein.

Preferably, the body of the container includes a shoulder sloping outwardly and downwardly from the finish, cylindrical walls extending downwardly therefrom and a bottom. The shoulders are preferably frustoconical. This structure provides for improved compressive strength and easier handling on the filling line over many other known bottle shapes.

For a more complete understanding of the above and other features and advantages of the invention, reference should be made to the following detailed description of preferred embodiments and to the accompanying drawings.

BRIEF DESCRIPTION OF THE DRAWINGS

FIG. 6 is a perspective view of an alternate container of the invention.

FIG. 7 is a top plan view of the container of FIG. 6.

FIG. 8 is a cross section along the lines 8—8 of FIG. 7.

FIG. 11 is a perspective view of an opening of an alternate container according to the invention.

FIG. 12 is a top plan view of the container of FIG. 11.

FIG. 13 is a cross section along lines 13—13 of FIG. 12.

FIG. 16 is a persepctive view of an alternate container of the invention with the cap in the closed position.

FIG. 17 is a top plan view of the container of FIG. 16.

FIG. 18 is a section along the lines 18—18 of FIG. 17.

FIG. 19 is a partial cross section along the lines 19—19 of FIG. 18.

DETAILED DESCRIPTION OF THE INVENTION

Figure 1:
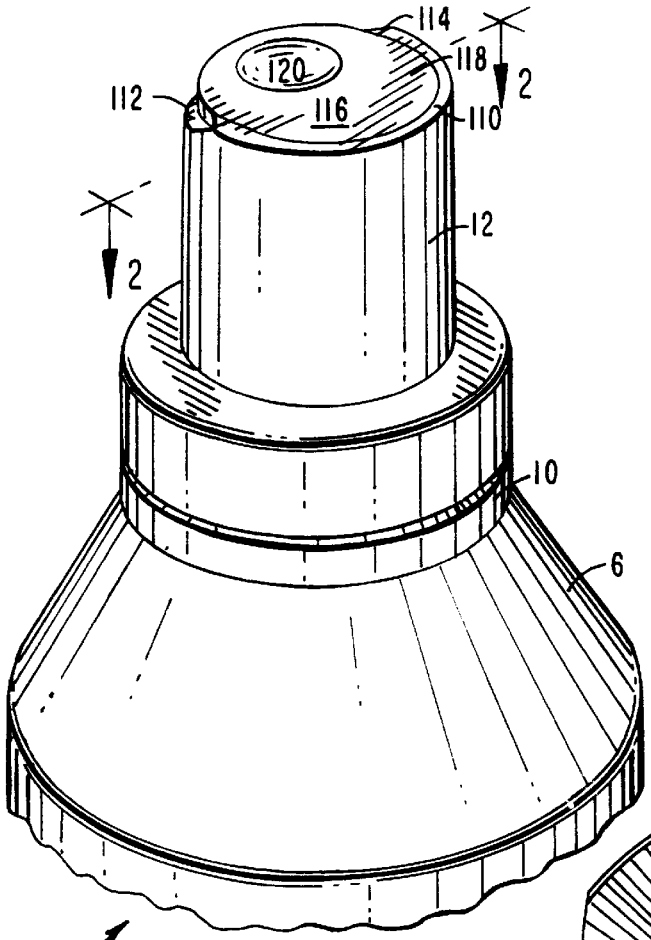
FIG. 1 is a perspective view of a container of the invention with the cap in the closed position.

Referring now particularly to FIGS. 1–5 of the drawings, there is shown a container 2 including a bottle 6 and a neck 10. The container 2 also includes a drainback fitment 14. Fastened to the top of the container 2, as viewed in FIG. 1, there is a closure 12. All of the foregoing components are preferably molded from a resilient plastic material. The materials may be selected so that the plastic from which the drainback fitment 14 is molded is softer than the materials from which the bottle 6 and closure 12 are formed. Alternatively, the drainback fitment may be made of a material of comparable hardness to that of which the closure is made, e.g., polypropylene.

Figure 5:
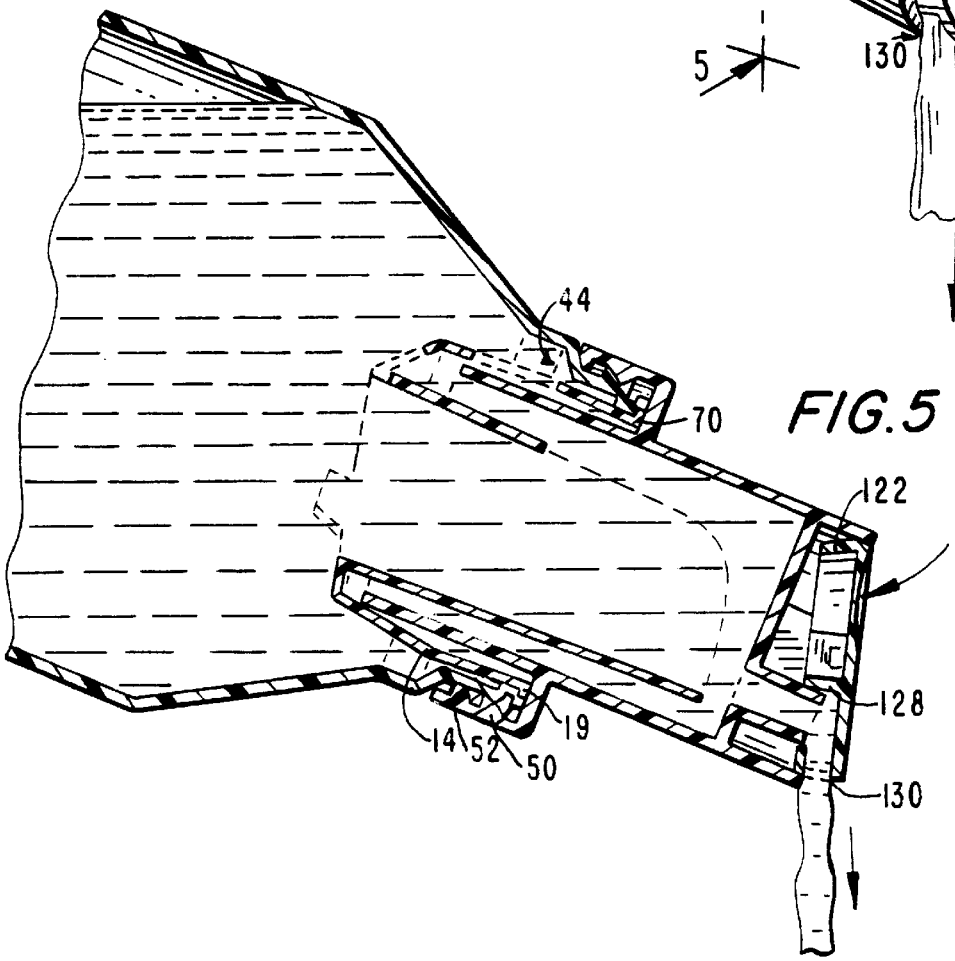
FIG. 5 is a cross section along the lines 5—5 of FIG. 4.

The drainback fitment has an outer, frustoconical wall portion 16 which gradually tapers downwardly and inwardly and is received within the neck 10 of the bottle 6. The wall portion 16 terminates at its upper end in an annular rim 19, as best seen in FIG. 5. Rim 19 is generally flat.

The surface of the rim turns downwardly and inwardly to form the outer wall 24 of a circumferential well 26 surrounding a generally frustoconical, eccentrically positioned spout 36, the lower periphery of which forms the inner wall 28 of the circumferential well 26. Between the outer wall 24 and inner wall 28 of the circumferential well 26 there is a sloping floor 30. The outer surface of wall 16 optionally includes a retaining ring which is spaced from and generally concentric with rim 19. Wall 16 includes fitment wall exit aperture (or drain port) located above and spaced from the product drainage aperture 32.

The opening of the spout 36 may be generally circular or may assume another shape, eg., the general shape of a teardrop. The teardrop is characterized by a pouring end of the spout which is comprised of a generally v-shaped section, formed by the intersection of two rectilinear sections, and by an arc connecting the ends of the v-shaped section.

If desired, the spout may include an anti-drip lip at its pouring end.

The product drainage aperture preferably comprises a substantially rectangular notch formed in the lowest and widest portion of the floor 30 and is in alignment with a longitudinal slot 34 which extends from the top of the rear of the spout. While the longitudinal slot may extend to the notch and merge therewith, the slot may extend only approximately halfway down the length of the spout. There, it meets with rear spout wall 35 which separates the slot 34 from the drainage aperture and also separates the interior of the spout from the circumferential well 26. Although the slot preferably meets the rear spout wall approximately halfway down the spout, it may instead meet the spout a quarter of the way, three quarters of the way or at other locations. Or, the slot may be entirely omitted.

The presence of rear spout wall 35 helps to minimize the double pouring which would otherwise occur through the longitudinal slot and strengthens the spout and helps it to maintain its structure.

Whether or not rear spout wall 35 is included, the spout may include projections to keep the fitments separated during stacking. Such projections may also serve to prevent rotation of the spouts during stacking when combined with lugs (not shown) depending from the bottom of the fitment and situated so that they block radial movement of the stacking projections on the next lower fitment when the fitments are stacked.

The product drainage notch and longitudinal slot 34 provide a path for residual liquid remaining on the spout 36 or closure 12 to drain back into the bottle 6 either directly or via the downwardly sloping floor 30 of the circumferential well 26 under the force of gravity when the container 2 is in an upright position.

Fitment 14 is secured to bottle finish 68 by a friction fit. Bottle finish 68 includes an annular mouth 70, a locking ridge 72 and a thread-containing lower portion 74. Locking ridge 72 includes an inwardly extending surface which projects inwardly toward the spout from the base of mouth wall 70 and a locking ridge wall which extends downwardly from the surface. The fitment is inserted into the bottle by forcing it through the opening at the bottle mouth and pushing it until annular rim 19 of the fitment is situated upon or immediately above locking ridge 72. In this position, the distal end of the annular rim will be adjacent to bottle mouth 70. Optionally a retaining ring disposed on the fitment at a level below the locking ridge helps to retain the fitment in position by abutting the lower aspects of locking ridge 72.

Portions of the inner wall 80 of the finish below the locking ridge may abut wall 16 of the fitment or may be spaced from the fitment.

The seal between the fitment and the bottle finish is the friction fit between the portion of wall 16 of the fitment below annular rim 19 and the wall descending from the inwardly-extending surface of locking ridge 72.

The drainback fitment 14 may be formed from a plastic such as high density polyethylene. Or the polyethylene may be the product of a 50:50 blend of a high density resin and a low density resin. The high density resin can be U.S.I. LS 506 or a similar resin. The low density resin can be U.S.I. LS 208 or the like. Instead of a mix of resins, a high density polyethylene or a low density polyethylene such U.S.I. 241 or even a harder material such as polypropylene may be used to form the fitment. Other plastic resins having chemical and physical properties similar to the aforementioned resins can be used to form the plastic suitable for use in fabricating the drainback fitment 14.

The closure 12 has an upper wall 38 which is merged at its circumference with a downwardly extending inner circumferential wall 46 having a surface onto which there may be integrally molded gripping teeth biased to present greater friction to the hand when the closure 12 is rotated counterclockwise to loosen it than when it is rotated clockwise for tightening. Alternatively, other gripping means, such as vertical ribbings, or no gripping means, may be employed.

The inner circumferential wall 46 is concentric with and spaced from an outer circumferential wall 40. Inner circumferential wall 46 extends downwardly beyond the length of the outer circumferential wall 40. The inner circumferential wall 46, the undersurface of the upper wall 38 and the cap structure set forth below form a cup for measuring the contents of the container 2 as it is poured from the bottle 6. A fill line can be molded into the inner circumference of the inner wall 46, if so desired.

The outer circumferential wall 40 and inner circumferential wall 46 are connected by a web 48 so that a downwardly facing (when the closure 12 is fastened to the bottle 6) channel 44 is defined between the inner circumferential wall 46 and the outer circumferential wall 40. The channel 44 is optionally lined, particularly along the inside of web 48, with a liner preferably made of a resilient, polymeric material. The channel 44 in cooperation with the frustoconical wall portion 16 and, optionally, liner 62 serves as a trap for preventing residual contents of the container 2 from migrating to the junction of the closure 12 and neck 10 of the bottle 6. If desired the liner may be omitted.

Upper wall 38 has formed therein product exit 102 which comprises aperture 104 and cylindrical exit wall 106. Inner circumferential wall 46 continues above upper wall 38. Approximately 220° of the wall 46 extends to a first height 110 and the most of the remaining 160° of the wall extends to a second, lower height 112. A gradual transition 114 occurs between the first and second heights at each the second wall height.

Cap 116 is snap fit in closure 12 above upper wall 38. Cap 116 comprises end wall 118, which includes finger depression 120, circumferential wall 122, and product exit abutting wall 128.

Figure 2:
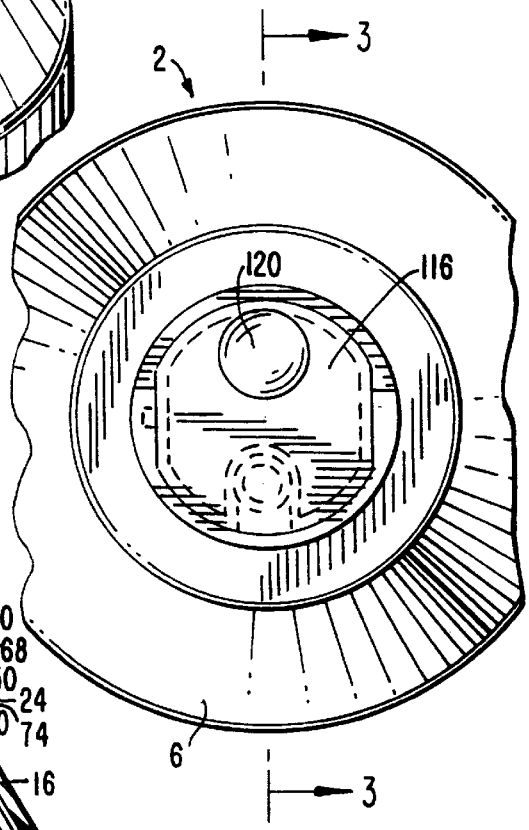
FIG. 2 is a top plan view thereof.

In operation, cap 116 is originally disposed in the closed position seen especially in FIGS. 1 and 2. In this position, egress of product through product exit 102 is blocked since top 118 of cap rests against the upper height area 110 of inner circumferential wall 46. In this position, product may be accessed by unscrewing the entire cap or by pressing the user's finger against depression 120 to snap the cap into the open position seen particularly in FIGS. 4 and 5, wherein cap product aperture 130 is disposed above the upper end of wall 46 whereby product is free to flow. The closure's disc top or cap pivots between the open position and the closed position when pressure is applied by the user's finger to the appropriate area of the top of the cap. If so desired, the consumer can leave the product exit in the closed position, unscrew the closure from the bottle and use the inverted closure as a measuring cup for the product.

In the alternate embodiment illustrated in FIGS. 6–10, the fitment and bottle are the same as in the previous version. The structure of the closure is similar, except for the cap. Here, it is not the entire top of the closure which serves as a cap. Rather, cap 140 includes a semicircular section 142 and a rectangular medial extension 144. The rectangle includes two opposed short ends and two opposed long ends. Projecting from each short end of the medial extension are pins 146 which are jounaled in bearings 148 situated in upper wall 150 of the closure. Upper wall 150, as can be seen in, eg, FIG. 8, is stepped, so that its front aspect is lower than its back section.

The lower, front section of upper wall 150 includes a product exit 152 in the form of a circular aperture. Depending from cap end wall 156 is plug 158, which is shaped to fit within the aperture of product exit 152 when cap 140 is in the closed position shown in FIGS. 6–8.

Figure 9:
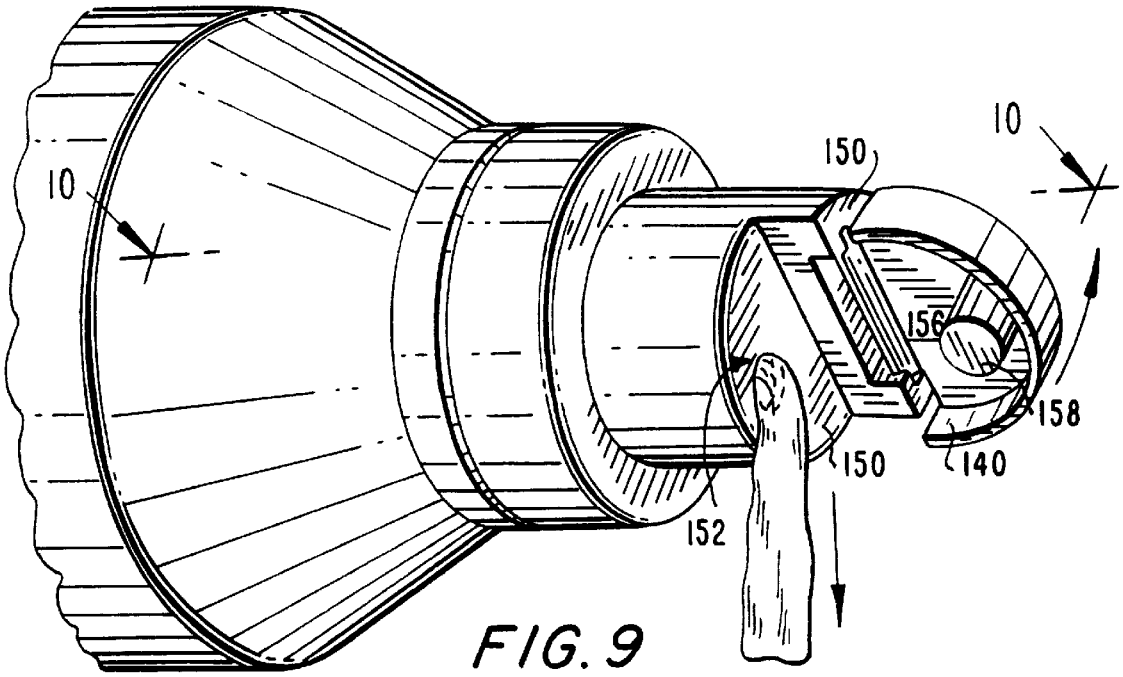
FIG. 9 shows a perspective view of the container of FIG. 6 with the cap open.
Figure 10:
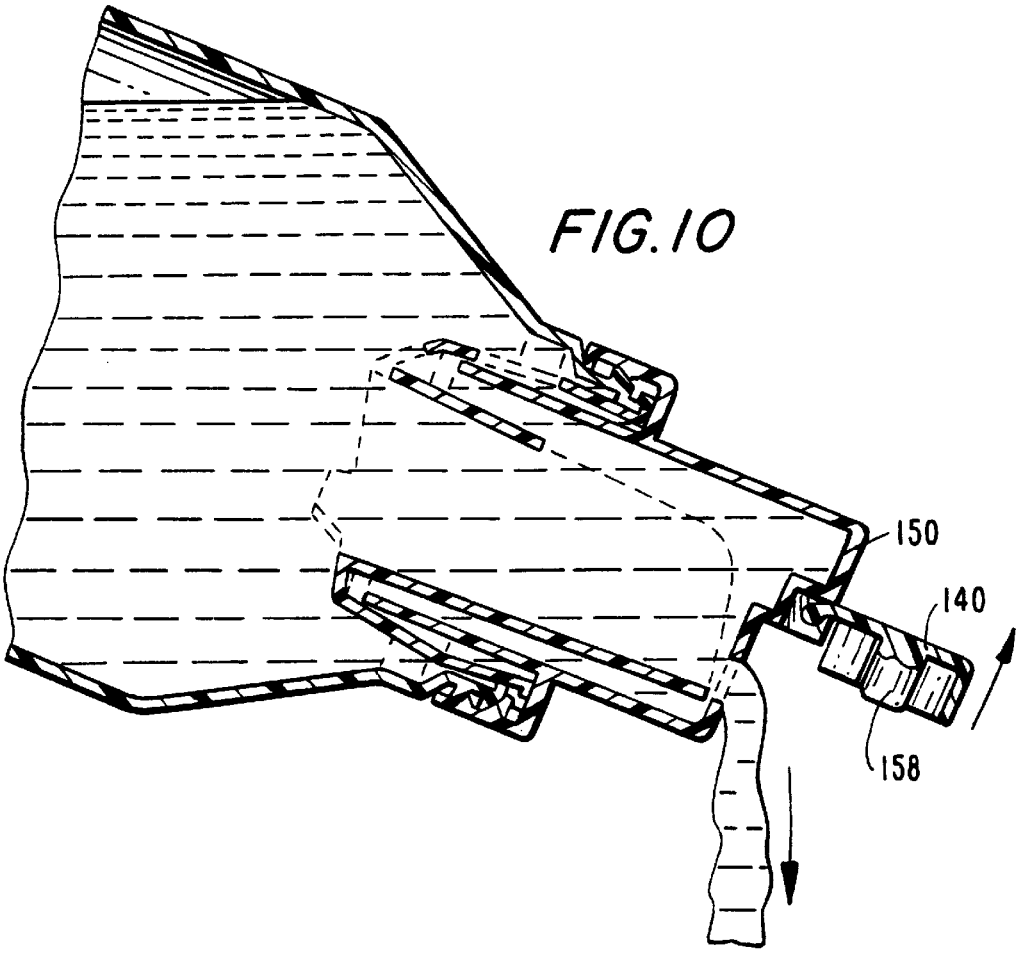
FIG. 10 is a cross section along the lines 10—10 of FIG. 9.
Figure 14:
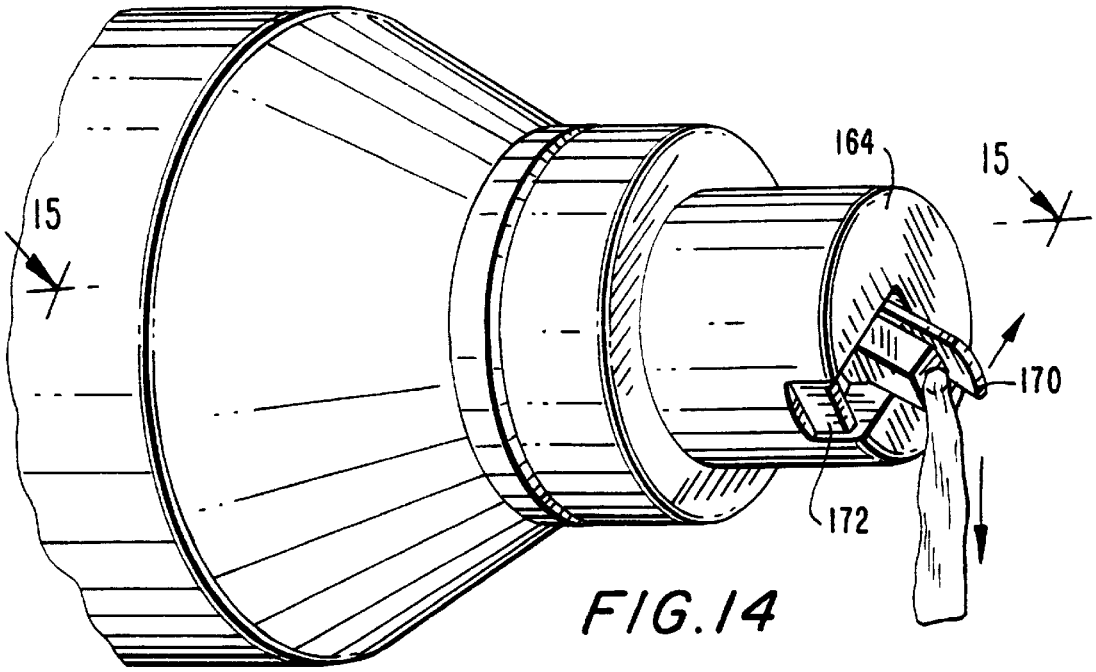
FIG. 14 is a perspective view of the container of FIG. 11 with the cap in the open position.
Figure 15:
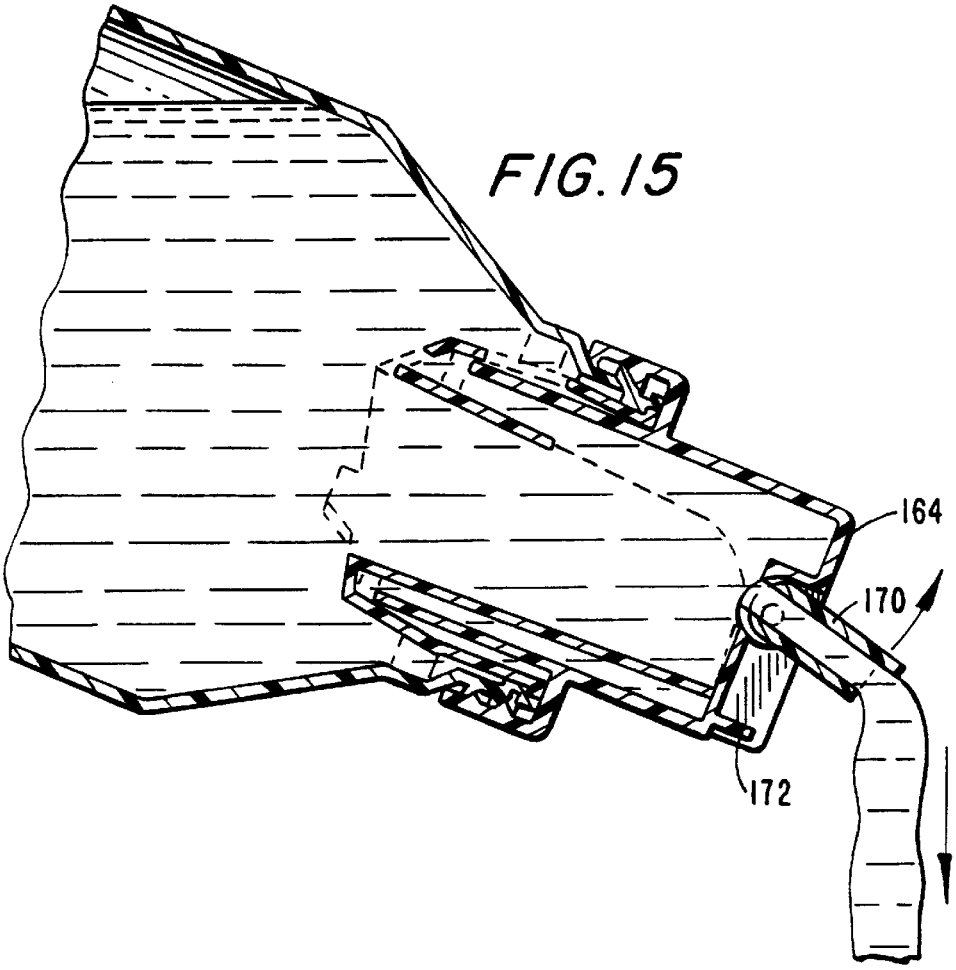
FIG. 15 is a cross section along the lines 15—15 of FIG. 14.

In operation, when the user wishes to pour small amounts of product out of the container, without unscrewing the cap, he/she can lift up cap 140, which pivots on pins 146 and place the cap in the open position seen in FIGS. 9 and 10. Product can be poured out of product exit 152. When the cap is in the closed position, plug 158 prevents product egress.

In the embodiment of FIGS. 11–15, the fitment, body and closure, are similar to those of previous embodiments. The main differences are to be found in the cap. Cap 160 includes pins 162 extending from either side of its medial end and received within bearings in closure upper wall 164. Cap 160 forms a rectangular channel through which product may exit after passing through exit 166 in upper wall 164. Upper wall 170 of cap 160 extends beyond auxilliary closure side wall 172 when the cap is in the closed position best seen in FIGS. 11 and 13. By pulling upwardly on the aspect of wall 170 which extends past the auxilliary closure side wall 172, the user can position cap 160 in the location shown in FIGS. 14 and 15 and thereby dispense limited amounts of the product without unscrewing the cap.

In the embodiment illustrated in FIGS. 16–21, upper wall 180 of closure 182 is stepped. On the lower step, a product exit 184 includes aperture 186 and upwardly extending circular wall 188 and four stops 190 at the top thereof.

Figure 20:
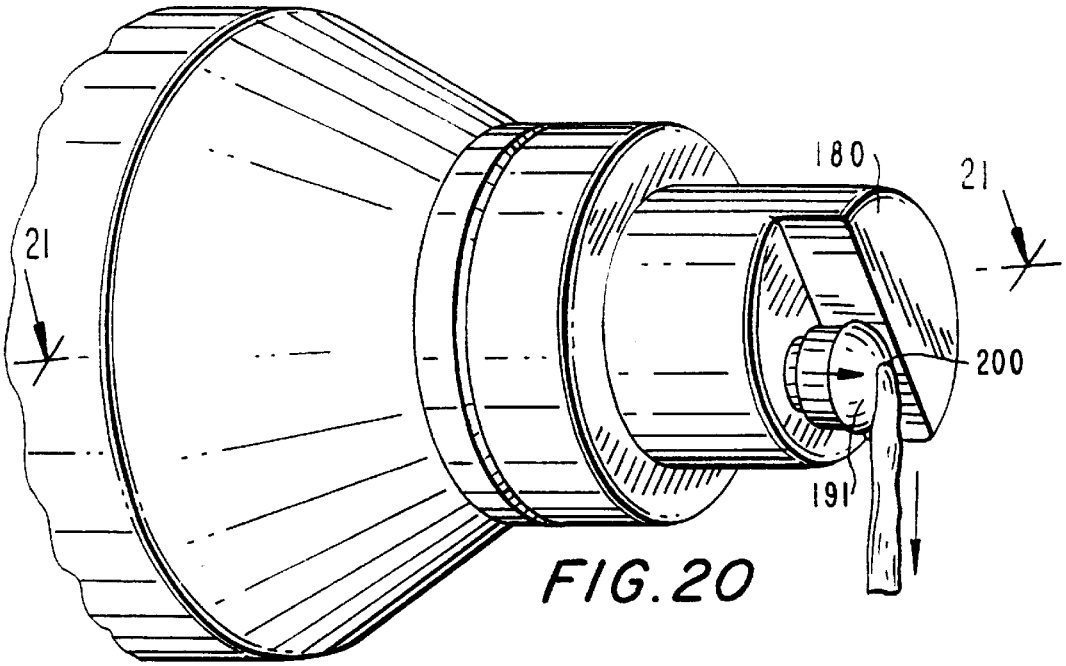
FIG. 20 is a perspective view of the container showing product exiting the container with the cap in the open position.
Figure 21:
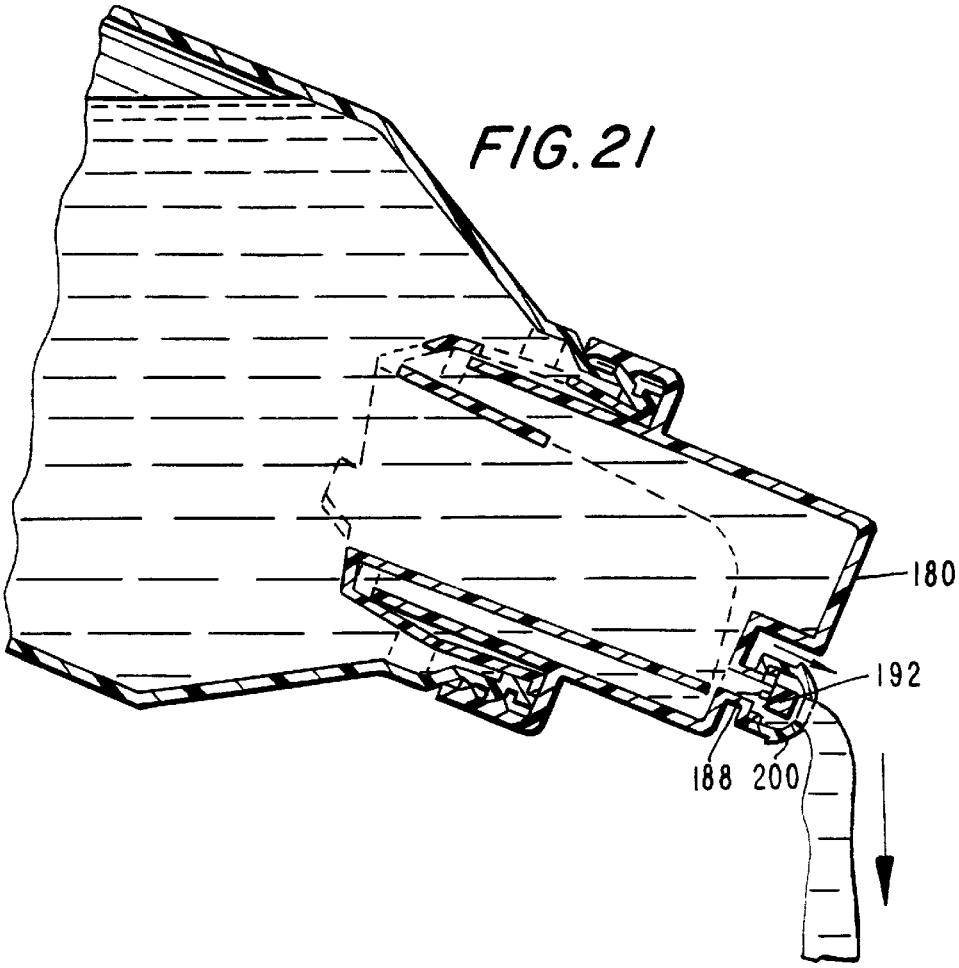
FIG. 21 is a cross section along the lines 21—21 of FIG. 20.
Figure 22:
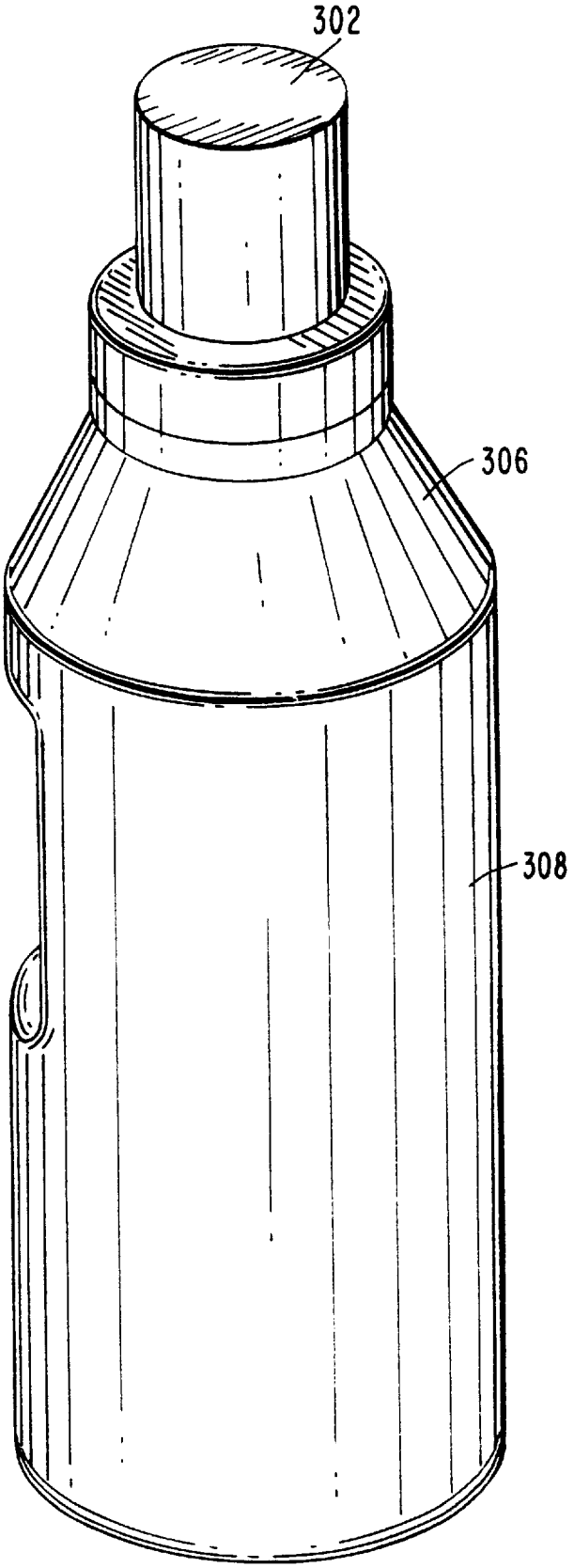
FIG. 22 is a perspective view of a container according to a further embodiment.
Figure 23:
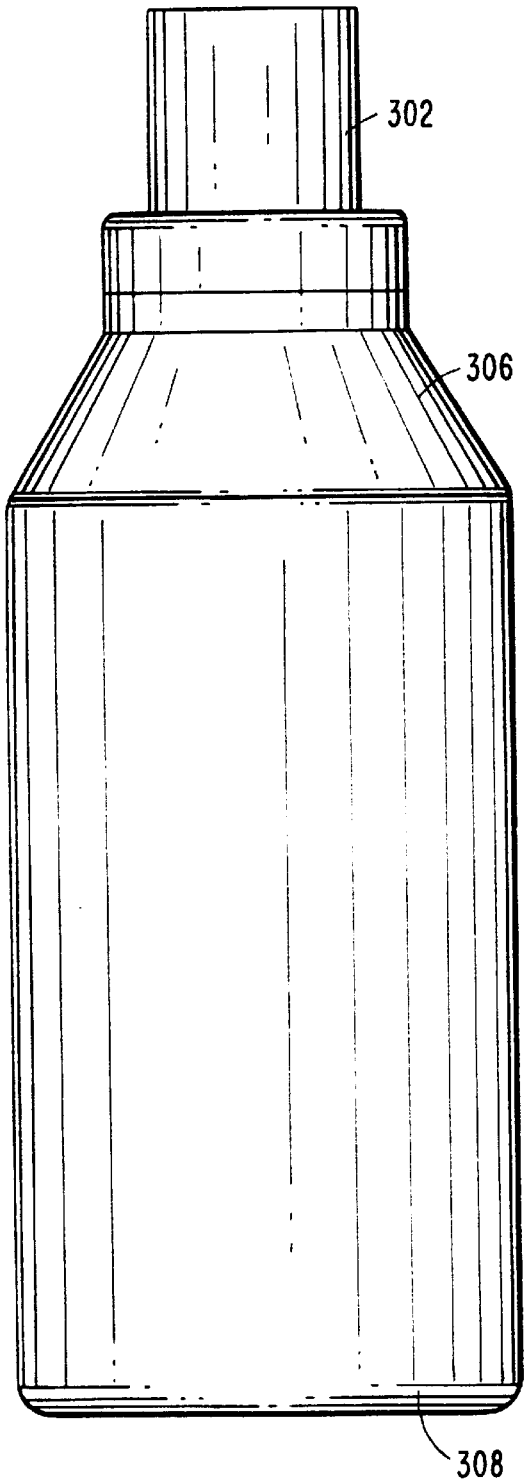
FIG. 23 is a front elevational view of the container of FIG. 22.
Figure 24:
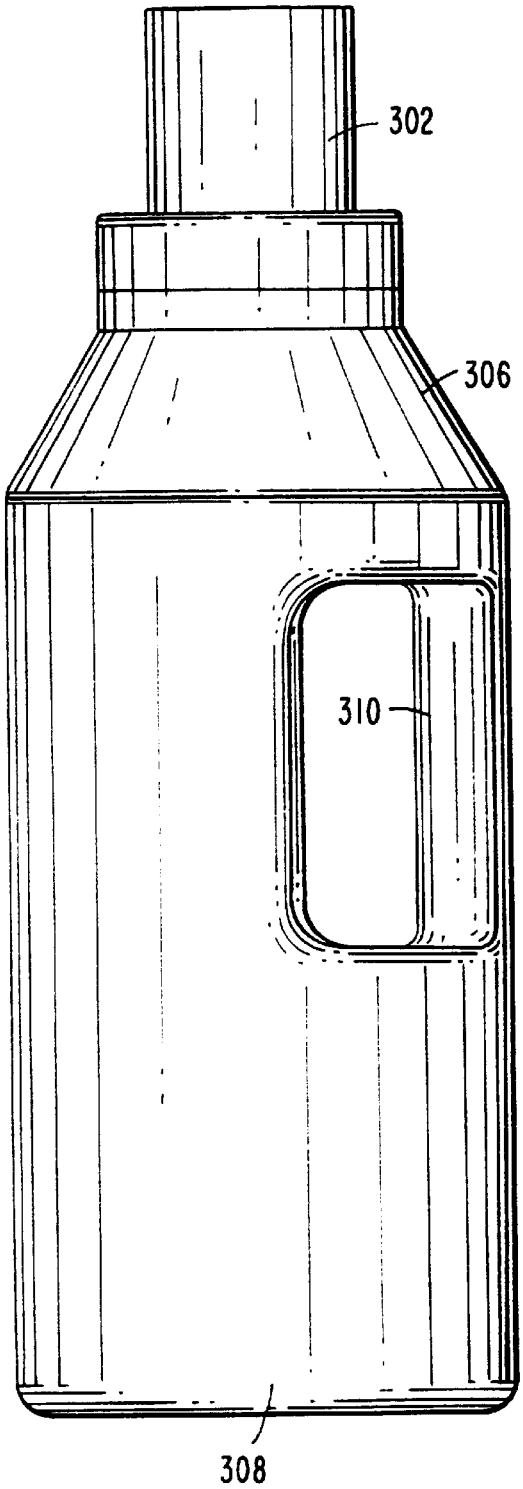
FIG. 24 is a side elevational view of the container of FIG. 22.
Figure 25:
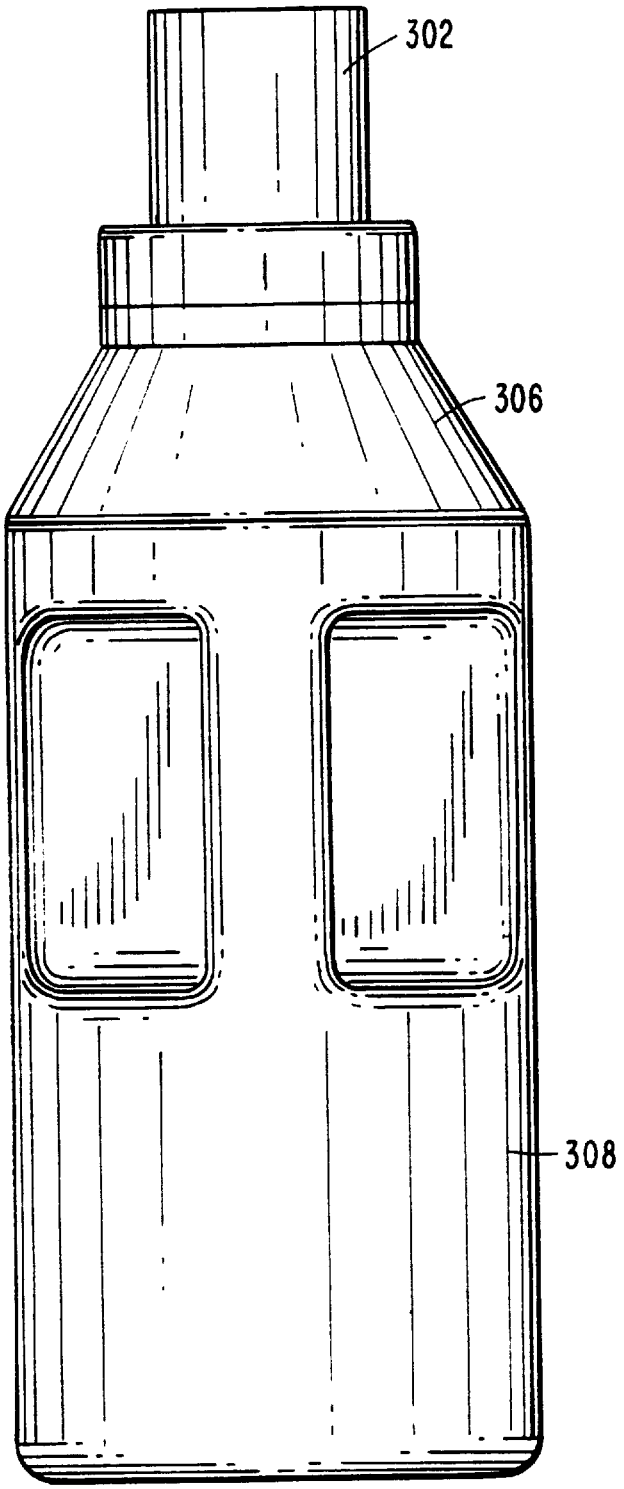
FIG. 25 is a rear elevational view of the container of FIG. 22.
Figure 26:
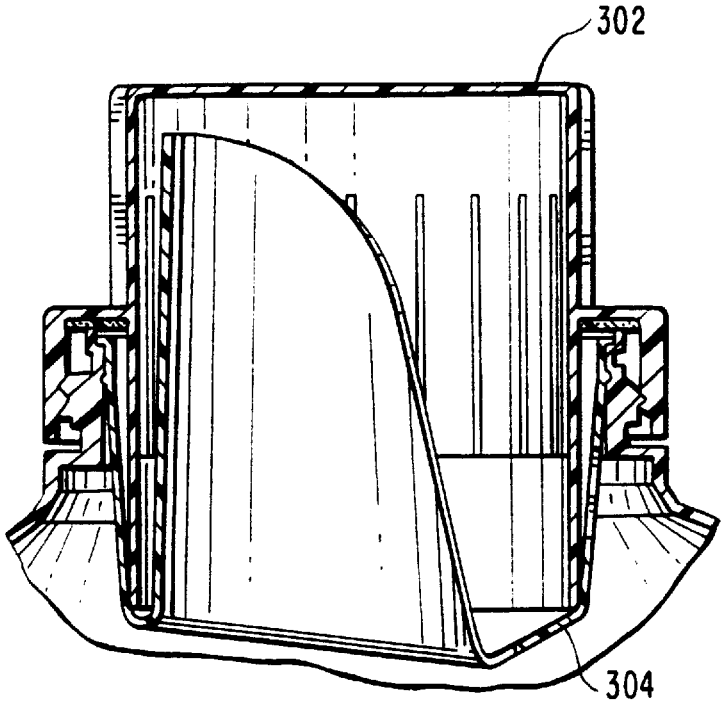
FIG. 26 is a cross section showing the fitment, finish and closure of the bottle of FIG. 22.

Mounted at the top of the stops 190 is bell 191 and bell plug 192. Bell 191 includes circumferential wall 194 and an inwardly extending flange 196 at the bottom thereof. Bell 191 is slidable up and down about circular wall 188 between a closed position wherein flange 196 is disposed in contact with lower step of upper wall 180 and an open position wherein flange 196 is positioned in contact with the underside of stops 190. In the open position, bell 191 includes a circular aperture 200 through which product can flow as seen in FIG. 20; in the closed position aperture 200 is filled by plug 192 and product cannot flow.

The user can move the bell between the open and closed positions by pulling or pushing.

The closure may be formed of a harder material than that used in the drainback fitment 14. In the preferred embodiment of the invention, the plastic material from which the closure 12 is molded is a homopolymer polypropylene such as that sold by Phillips Petroleum Company under the designation Phillips HLV 120-01.

The bottle 6 also may be formed of a material that is harder than the material employed in the drainback fitment 14. Alternately, the fitment may be formed of a harder material, as where the fitment is fabricated from polypropylene. The fitment including the spout is preferably fabricated from high density polyethylene, polypropylene or low density polyethylene. Preferably, the bottle is fabricated from a high density polyethylene. Another resin sold by U.S.I. under the designation .955 density, OI-388-2 is a suitable material. Other materials exhibiting similar chemical and physical properties can be substituted.

Complementary fastener means, preferably in the form of threads, are provided on the closure 12 and neck 10 of the bottle 6 at their juncture. The closure 12 has internal threads 50 which mate with external threads 52 on the finish 68 of the bottle. As the closure 12 is threaded onto the neck 10 of the bottle 6, the liner, if present, engages the mouth 70 of the bottle 6 thereby sealing the bottle to prevent leakage of the contents from the container. When the liner is omitted, the top of channel 44 seals against the mouth 70 of the bottle.

The inside of the land of the bottle may be beveled to assist in sealing. The bevel imparts to the top of the mouth a sharp point from which the inner wall of the mouth slants inwardly. The outer wall of the mouth is disposed generally vertically. Whether the closure is on or off, the friction fit of fitment 14 against locking ridge 72 within the bottle finish 68 prevents escape of the product except through the spout, the drainage aperture or the product exit in the wall of the fitment. When the closure is screwed closed, any product which has exited bottle 6 through the spout, drainage aperture or fitment wall exit aperture is contained within container 2 by the closure, unless the product exit is open, eg by the cap being in the open position.

Figure 3:
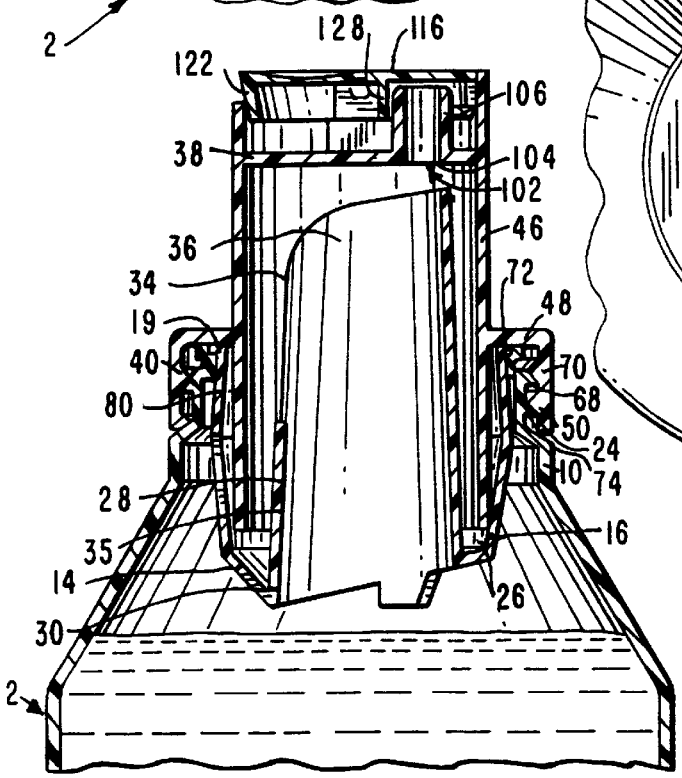
FIG. 3 is a section along the lines 3—3 of FIG. 2.
Figure 4:
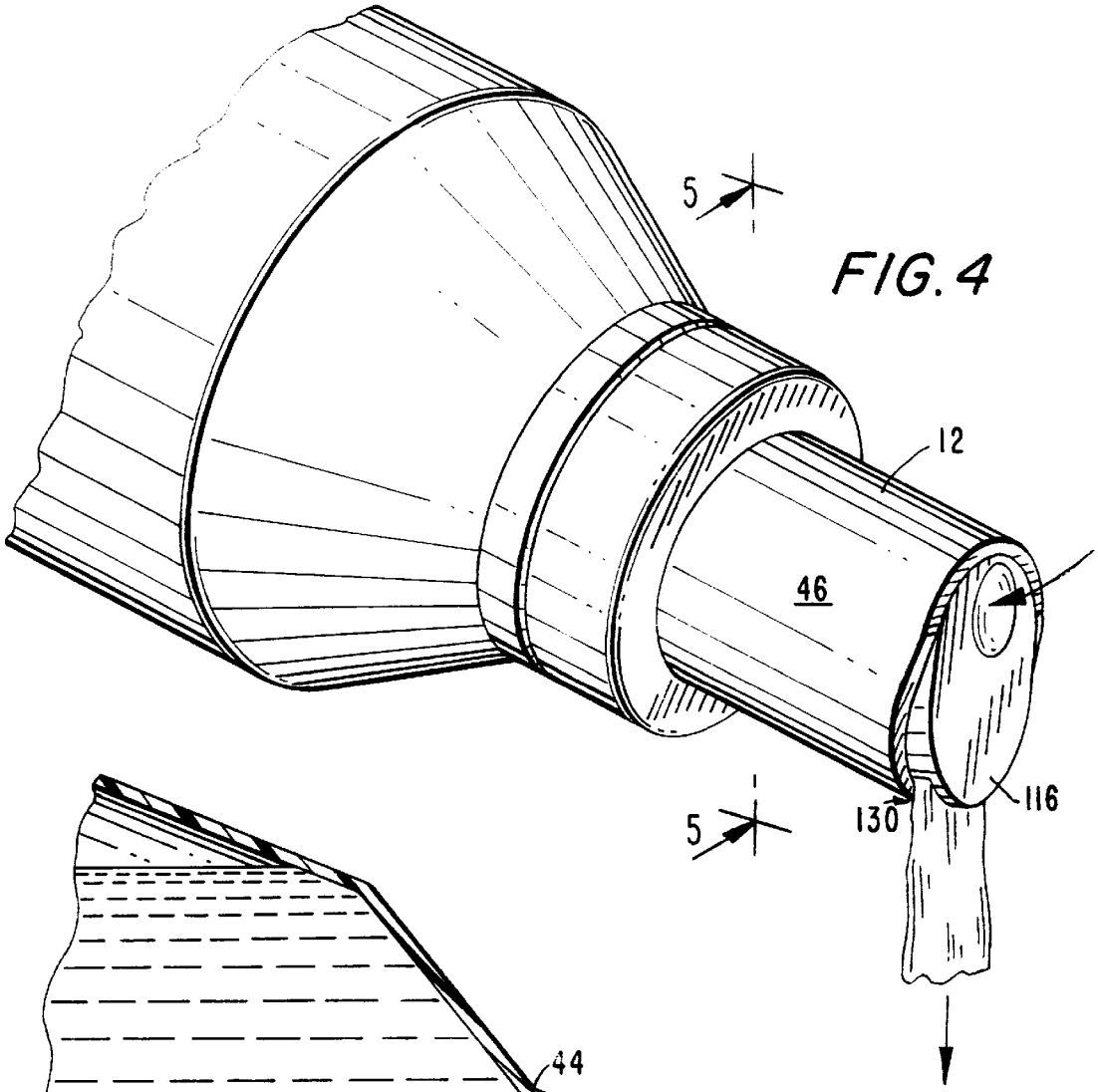
FIG. 4 is a perspective view of the container showing product exiting the container with the cap in the open position.

As is apparent from FIG. 3, except for the spout, fitment 14 is wholly contained within the bottle 6. The entire outer wall 16 is situated below the mouth 70 of this bottle. Also, the fitment wall exit aperture is most useful where the outer wall of the fitment is sufficiently spaced from the shoulder or other wall of the bottle such that more than a mere drop or two of product is entrapped.

Although the fitment herein has been illustrated as having a single fitment wall exit aperture, a plurality of apertures may be utilized.

In addition to serving to permit use of the last portion of the product, the product drainage aperture also serves as a vent hole as well. As such, it permits air to enter the container as product leaves through the spout.

The fitment wall exit aperture may assume any shape and size suitable for permitting exit of at least a portion of the last fraction of product trapped between the outside of the fitment and the wall of the bottle, e.g. triangular, rectangular, square or round, or may take the form of a slit. Preferably, the fitment wall exit aperture is of a size and shape suitable for venting, as well. The fitment wall exit aperture is located high enough in the fitment wall such that at least a portion of liquid trapped when the bottle is turned upside down can esclosuree. The fitment wall exit aperture is illustrated herein as being positioned approximately halfway down the wall of the fitment, although it may be located one quarter of the way down or three quarters of the way down or elsewhere, depending on the dimensions of the container.

While certain features such as the annular rim and the retaining ring have been illustrated and/or described as extending 360 degrees around the circumference of the fitment, it will be apparent that such will not always be necessary in order that their functions be fulfilled in accordance with the invention. For instance, the annular rim may be replaced by other stopping means and the retaining rim may be replaced by other retaining means. Stopping means refers to the annular rim and equivalent structures even in fitments and containers wherein the friction fit between the fitment wall 16 and the locking ridge 72 is sufficient to prevent the entire fitment from being pushed through and into the bottle.

It will be apparent that the pouring fitment and container of the invention may be used for liquid laundry and other detergents, fabric softeners and many other types of liquid household and other products.

FIGS. 22–26 illustrate another embodiment of the invention. This embodiment combines a pouring and drainback fitment of the type generally described herein with a closure which may include the caps illustrated in the previous figures or which may include instead the prior art cap 302 and fitment 304 illustrated in FIGS. 22–26, together with an advantageous bottle shape, namely shoulders 306 sloping downwardly and outwardly from the bottle finish and a generally cylindrical body 308 extending downwardly to the bottle bottom from the bottom of the shoulders. The cylindrical body may be interrupted to form a handle, 310, if desired.

The body structure illustrated in FIGS. 22–25, particularly the sloping shoulder and cylindrical body wall provides for improved compressive strength and easier handling on the filling line over many other known bottle shapes. For instance, using the indicated structure, surprisingly low ratios of bottle body weight (in grams) to compressive strength (in pounds) are possible. Compressive strength is measured using The Society of Plastics Industry (SPI) standard Vertical Compression Test PBI3-1978. The bottle body weight is measured without the fitment or closure. Ratios for bottles according to this aspect of the invention may be 1 and less, especially 0.75 and less, and most preferably 0.5 or even 0.4 and less. Also advantageous for compressive strength and otherwise is that the neck is centered.

It should be understood, of course, that the specific forms of the invention herein illustrated and described are intended to be representative only, as certain changes may be made therein without departing from the clear teachings of the disclosure. For instance, the closures may be used with different bottle bodies. Or, the body structure illustrated in FIGS. 22–25 may be used with different closures. Accordingly, reference should be made to the following appended claims in determining the full scope of the invention.

What is claimed:

1. A container comprising:

a) a finish having a finish mating structure;

b) a body extending downwardly from said finish;

c) a fitment fit within said finish and including i) a generally annular side wall and ii) a bottom wall extending inwardly from a bottom of said side wall and including a product drainage aperture;

d) a pour spout extending upwardly from said bottom wall generally concentrically with said side wall;

e) a closure having an upper wall, a circumferential product receiving wall extending therefrom, a closure mating structure suitable for mating with the finish mating structure, said closure upper wall comprising a reclosable product exit.

2. The container according to claim 1 wherein said finish includes i) an annular mouth; and ii) a locking ridge extending inwardly from said mouth, said annular sidewall of said fitment frictionally abutting the locking ridge of said finish.

3. The container of claim 1 wherein said circumferential wall is an inner circumferential wall and wherein said closure mating structure comprises an outer circumferential wall concentric with and spaced from said inner circumferential wall, a web parallel to and spaced from said upper wall and connecting said inner and outer circumferential walls.

4. The container according to claim 3 wherein said finish mating structure comprises threads formed on the outside of said finish and wherein said closure mating structure further comprises threads formed on the inside of said outer circumferential wall.

5. The container according to claim 1 wherein said product exit is opened and closed by a reclosable closure top pivotable between an open position wherein product can escape through said product exit to the outside of said container and a closed position wherein product cannot egress from said closure to the outside of said container.

6. The container according to claim 5 wherein said product exit in said upper closure wall comprises a cylindrical exit wall, said cylindrical walls being disposed generally parallel to said product receiving circumferential wall.

7. The container according to claim 6 wherein said closure cap comprises an end wall generally parallel to said upper wall, an abutting wall which depends from said end wall and abuts said product exit wall when said cap is in the closed position, and a cap circumferential wall depending from the end wall of said cap along the pheripery of said cap.

8. The container according to claim 7 wherein said cap circumferential wall includes an aperture through which product may exit the cap when the cap is in the open position.

9. The container according to claim 5 wherein said cap compises two opposed ends and said ends each include pins extending therefrom and received within bearings in said upper wall.

10. The container according to claim 5 wherein said upper wall forms at least two steps, and said cap includes an end wall generally parallel to said upper wall, a circumferential wall depending from said end wall throughout at least 45° of the pheriphery of said cap and a plug depending from said end wall, said plug being accommodated within said product exit in said upper wall when said cap is in said closed position, whereby to block egress of product.

11. The container according to claim 9 wherein said upper wall forms at least two steps, and said cap includes an end wall generally parallel to said upper wall, a circumferential wall depending from said end wall throughout at least 45° of the pheriphery of said cap and a plug depending from said end wall, said plug being accommodated within said product exit in said upper wall when said cap is in said closed position, whereby to block egress of product.

12. The container according to claim 9 wherein said cap forms a channel through which said product flows when said cap is in the open position, said channel including a end wall and said upper wall including an auxiliary wall extending upwardly therefrom perpendicularly to said channel end wall and in contact with said channel end wall when said cap is in the closed position whereby to prevent egress of product from the container.

13. The container according to claim 1 wherein said upper wall product exit comprises a surrounding wall surrounding said exit and extending generally perpendicularly to said upper wall, a bell received slidably on said product exit wall, said product exit wall further comprising a bell slide stop at one end thereof preventing said bell from sliding past said product exit wall end, and a bell plug mounted on said bell slide stop for blocking product exit blocking through said bell aperture when said bell is in the closed position.

14. A container comprising:

a) a finish having a finish mating structure;

b) a body extending downwardly from said finish;

c) a fitment fit within said finish and including i) a generally annular side wall and ii) a bottom wall extending inwardly from a bottom of said side wall and including a product drainage aperture;

d) a pour spout extending upwardly from said bottom wall generally concentrically with said side wall;

e) a closure having an upper wall having a reclosable product exit, a circumferential product receiving wall extending therefrom, and a closure mating structure suitable for mating with the finish mating structure, f) said body comprising shoulders sloping downwardly and outwardly from said container finish, and a cylindrical wall extending downwardly from said shoulders to a bottom wall.

* * * * *